United States Patent [19]

Brookbank, III

[11] 4,453,892

[45] Jun. 12, 1984

[54] SUBMERGIBLE PUMP INSTALLATIONS

[75] Inventor: Earl B. Brookbank, III, Bartlesville, Okla.

[73] Assignee: TRW Inc., Cleveland, Ohio

[21] Appl. No.: 280,793

[22] Filed: Jul. 6, 1981

[51] Int. Cl.[3] ..... F04B 49/00; F04B 39/08; F16K 31/12

[52] U.S. Cl. ..... 417/279; 417/507; 137/508; 166/319

[58] Field of Search ..... 417/260, 279, 458, 459, 417/112, 559, 562, 563, 564, 507; 166/319, 370; 137/528, 538, 508

[56] References Cited

U.S. PATENT DOCUMENTS

| | | | |
|---|---|---|---|
| 1,266,552 | 5/1918 | Chapman . | |
| 2,251,244 | 7/1941 | Stanley | 166/370 |
| 2,473,620 | 6/1949 | Teague, Jr. | 137/508 |
| 2,727,532 | 12/1955 | Sousa et al. | 137/528 |
| 2,760,512 | 8/1956 | Nechine | 137/107 |
| 2,858,910 | 11/1958 | Smith | 188/96 |
| 3,066,837 | 12/1962 | Griffith et al. | 222/385 |
| 3,086,550 | 4/1963 | Cummings | 137/514 |
| 3,364,950 | 1/1968 | Zajdler | 138/31 |
| 3,437,110 | 4/1969 | Birdwell | 137/528 |
| 3,477,507 | 11/1969 | Page, Jr. | 166/224 |
| 3,636,969 | 1/1972 | Jacobellis | 137/115 |
| 3,672,795 | 6/1972 | Arutunoff et al. | 417/424 |
| 3,730,215 | 1/1973 | Conery et al. | 137/494 |
| 3,807,894 | 4/1974 | O'Rourke | 415/147 |
| 3,845,876 | 11/1974 | Needham et al. | 220/203 |
| 3,851,997 | 12/1974 | Douglas | 417/112 |
| 3,942,551 | 3/1976 | Schuller et al. | 137/514 |
| 3,970,144 | 7/1976 | Boykin, Jr. | 166/319 |
| 4,021,137 | 5/1977 | Zehren | 415/147 |
| 4,083,409 | 4/1978 | Barrington | 166/320 |
| 4,167,198 | 9/1979 | Kotyza et al. | 137/528 |
| 4,171,934 | 10/1979 | Zehren | 415/360 |

FOREIGN PATENT DOCUMENTS 749740 1/1967 Canada .

*Primary Examiner*—William L. Freeh
*Assistant Examiner*—Paul F. Neils
*Attorney, Agent, or Firm*—Shapiro and Shapiro

[57] ABSTRACT

A pump discharge assembly for a submergible pump installation, for use in an oil well and the like, has inlet ports for receiving liquid from a pump discharge, which ports are regulated by a back-pressure compensating valve. The valve obturates the ports upon start-up of the pump and prevents liquid being pumped unless or until the pump discharge pressure has attained a suitable level. The arrangement prevents excessive flow rate on start-up of the pump if the back-pressure is too low.

10 Claims, 5 Drawing Figures

SUBMERGIBLE PUMP INSTALLATIONS

BACKGROUND OF THE INVENTION

The invention relates to submergible pump installations used, for example, in wells when artificial lift is required, for pumping well liquid to the surface.

Downwell submergible pump installations generally comprise a pump, commonly of the centrifugal type, and ancillary equipment such as a pump discharge head, an electric drive motor for the pump, and a motor protector, for example. The entire installation may be suspended in a well by tube or cable, and the pump may operate directly in a well casing, or in a liner contained within the casing. In either case, when operated, the pump draws in well liquid from beneath the installation and discharges it into the casing or liner through the discharge head. A suitable packoff or seal separates the low-pressure inlet side of the casing or liner from the high-pressure discharge side. When suspended by a tube, the pump may discharge into this tube.

When the pump has operated continuously for a period sufficient for liquid to be pumped from the well, the well tubing (casing or liner) above the pump installation is filled with liquid, so that the pump operates against a back pressure created by this height of liquid. On start-up, however, there may not be a sufficient height of liquid in the well tubing above the pump to create a back pressure of sufficient magnitude for the pump to operate satisfactorily. Insufficient back pressure may, for example, produce excessive flow rates creating vibrations which can cause rotating seals to leak.

To provide sufficient back pressure for a downwell pump on start-up, previously, the well tubing has, for example, been filled by external means, with a control valve provided at the surface. This procedure however has not always been practical or possible, resulting in extended periods of pumping at high flow rates before control can be effected by a surface valve.

The present invention provides means for use in controlling a submergible pump installation so as to maintain operation of the pump against a suitable back pressure.

SUMMARY OF THE INVENTION

In accordance with the invention, a pump discharge assembly for a submergible downwell pump installation includes port means through which pumped liquid is adapted to flow when passing from a pump discharge through the assembly, movable valve means for opening and closing the port means, and control means for positioning the valve means relative to the port means dependent on the relationship between liquid pressure at the pump discharge and a reference pressure that is independent of environmental (i.e., downhole) pressure, so that the valve means opens the port means only when liquid pressure at the pump discharge exceeds the reference pressure.

In a preferred form of the invention, for example, the control means for the valve means may include an expandable and retractable bellows assembly adapted to move the valve means between port-closing and port-opening positions dependent on changes in pressure differential between the interior and exterior of the bellows assembly. In use, the interior of the bellows assembly may be subject to the reference pressure, while the exterior of the bellows assembly is subject to the pressure of liquid at the pump discharge.

Additional features of the invention will be apparent from the ensuing description and claims taken in conjunction with the accompanying drawings.

BRIEF DESCRIPTION OF DRAWINGS

To provide a drawing of enlarged scale, FIG. 2 is divided in two, the portion of the discharge head shown on the left being the upper portion, and the portion shown on the right being the lower portion.

DESCRIPTION OF PREFERRED EMBODIMENT

Figure 1:
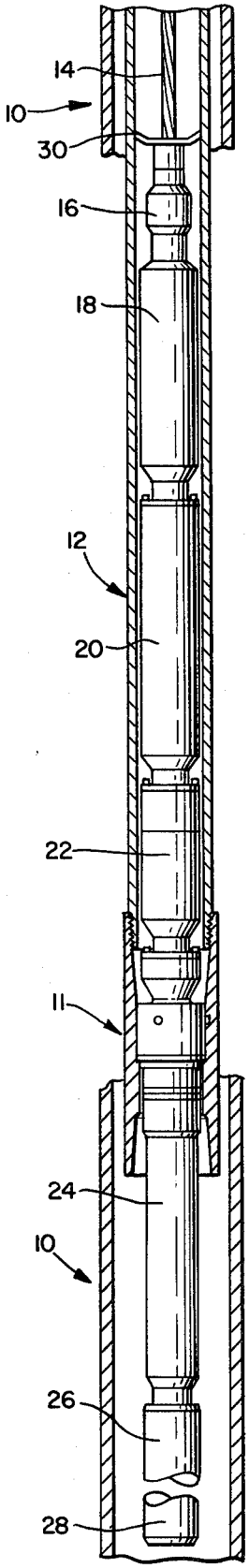
FIG. 1 is an elevational view of a submergible pump installation in a well, the well tubing being shown in section.

FIG. 1 shows a pump installation installed in a well having a well casing 10. The casing extends downwardly from a wellhead (not shown) on the earth's surface, or on a sea bed, and contains a separate coaxial liner 12. Liner 12 may be supported on the wellhead and extend down to a level at which a discharge head of the pump installation is located when in operative position in the well. The liner terminates in a shoe 11 into which the discharge head fits as will be described. (While the invention is described with reference to a pump installation in a well of the type using a casing liner, it may also be employed in installations where there is no liner and where the pump discharges directly into the well casing or into other tubing. The term "well tubing" is used herein generically, to include all such systems.)

The pump installation is preferably lowered into the well through liner 12 by means of a cable 14, which may include weight-supporting strands as well as insulated electrical conductors. Alternatively, separate weight-supporting and electrical cables may be used, or the pump installation may be lowered by tubing. In the illustrated arrangement, the weight-supporting strands of cable 14 are anchored in a cable socket 16. Suspended co-linearly from the socket 16 are a pothead or splicing chamber 18, an electric motor 20, a motor protector 22, a discharge head 24, and a centrifugal or turbine pump 26, having an intake 28. A rubber sand check 30 may also be provided. Further details of a submergible pump installation are found, for example, in U.S. Pat. No. 3,672,795, the disclosure of which is incorporated herein by reference.

Figure 3:
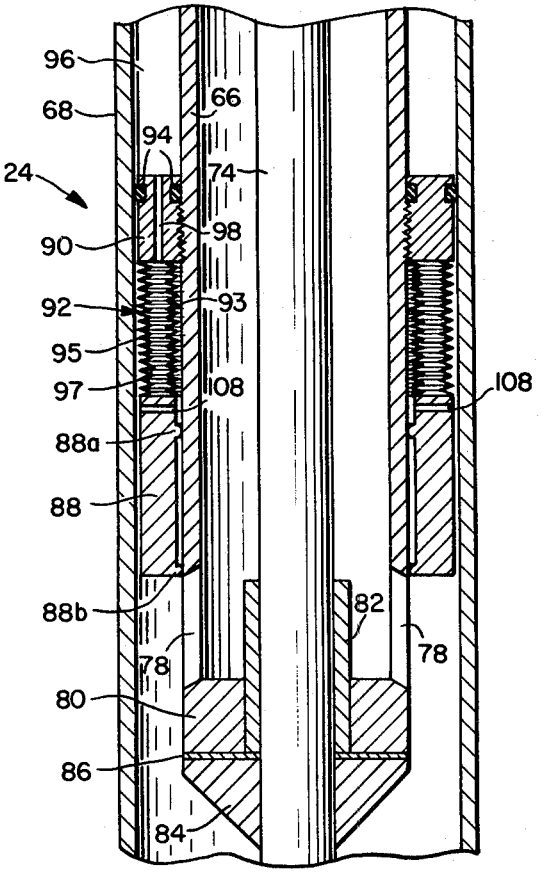
FIG. 3 is a sectional elevation of a part of the discharge head shown in a liquid pumping mode.
Figure 2:
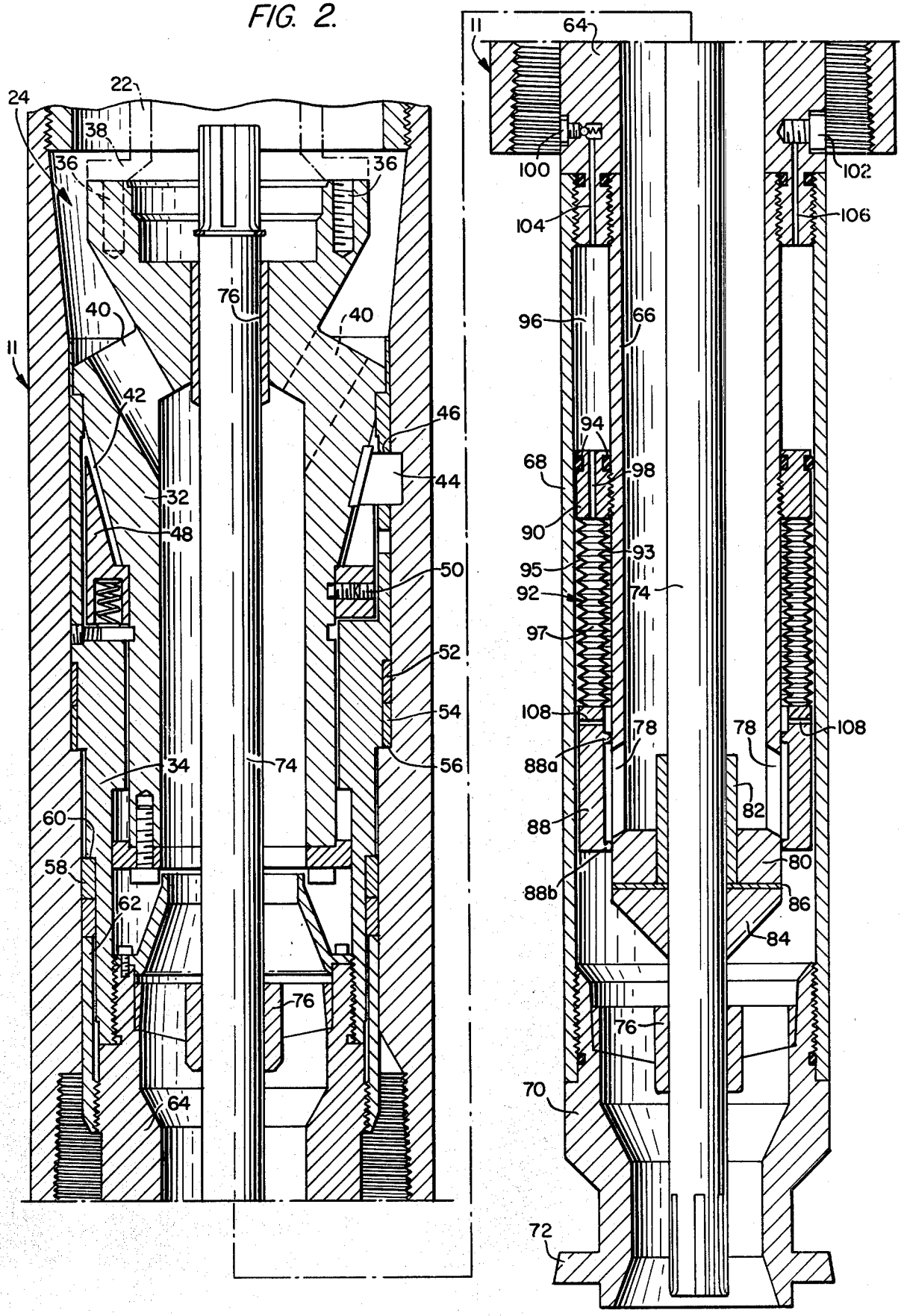
FIG. 2 is a sectional elevation of a pump discharge head for the installation shown in FIG. 1.

Referring now to FIGS. 2 and 3 which show discharge head 24 in greater detail, it will be noted that the discharge head includes an inner member 32 and an outer member 34 (see left-hand portion of FIG. 2). The upper end of the inner member may be provided with tappings 36 for screwing the discharge head onto a flange 38 at the base of protector 22. Additionally, the inner member has, in known manner, a number of circumferentially spaced discharge ports 40 for discharging pumped well liquid from the interior of the discharge head into liner 12 as will be described. Beneath the discharge ports, the inner member 32 has a tapered outer surface 42 with which are associated a plurality of locking lugs 44 received in windows 46 in outer member 34. Lugs 44 are carried in vertical slots in a sleeve 48 secured to the inner member by screws 50.

Outer member 34 carries an external toothed ring 52, which, when the installation is lowered into the well, mates with a complementary toothed ring 54 on a shoulder 56 in shoe 11, so as to locate the discharge head. A stack of seal rings 58 is adapted to seal against the interior wall of shoe 11, the rings being located between a shoulder 60 of the outer member and a retainer sleeve 62 screwed to a tubular member 64, which is itself screwed to the lower end of outer member 34.

When the discharge head is lowered into the well and rings 52, 54 are brought into engagement, limited axial movement takes place between inner and outer members 32 and 34 sufficient to move the locking lugs 44 on surface 42, so that the lugs are projected from windows 46 into a recess formed in the inner wall of shoe 11. The discharge head is thus effectively locked in position and prevents unseating of the pumping installation by bottom-hole pressure.

The features of the discharge head described above are disclosed in greater detail in U.S. Pat. No. 4,171,934 incorporated herein by reference. These particular features of the discharge head are optional as regards the present invention and they will not therefore be described herein in more detail. A fuller understanding of the construction and operation of the above aspects of the discharge head may be obtained from the aforementioned patent.

Reverting to FIGS. 2 and 3, to the lower end of tubular member 64 are screwed an inner cylinder 66 and a longer outer cylinder 68 (see right-hand portion of FIG. 2). The lower end of the outer cylinder is connected to a tubular base member 70 with a flange 72, by which the discharge head may be connected to pump 26. Internally, a shaft 74 extends axially through the discharge head, suitably journalled in known manner in bearings 76. The shaft may have splined ends as shown, for coupling to corresponding shafts in the motor protector and pump respectively, to form a drive connection between the motor and the pump.

Inner cylinder 66 is formed, adjacent its lower end, with a plurality of circumferentially spaced inlet ports 78 and the cylinder has a flange 80 at its lower end carrying a bushing 82 in which the shaft is journalled. A thrust runner 84 is secured to shaft 74 beneath flange 80, and a compressible thrust washer 86 is mounted between the runner and flange 80.

The configuration of the discharge head as thus far described is such that well liquid may be received in base member 70 from the pump discharge, for flow through ports 78 into the interior of cylinder 66 and discharged into the well liner through ports 40.

In accordance with the invention, valve means in the form of a tubular valve element 88 is provided for obturating ports 78 in conditions when liquid pressure at the pump discharge is below a predetermined value and for opening the ports to allow liquid to flow through the discharge head when the predetermined pressure value is exceeded.

Valve element 88 is suspended from a ring member 90 by an expandable and retractable bellows assembly 92 forming control means for the valve element and comprising internal and external tubular bellows members 93, 95 suitably secured, as by welding, to the ring member and the valve element. Bellows members 93, 95 define an enclosed bellows space 97 therebetween. The ring member 90 may be screwed onto internal cylinder 66 prior to assembly of the external cylinder 68, with O-ring seals 94 being provided between the ring member and the respective cylinders. An annular pressure chamber 96 is thus formed between ring member 90 and the base of the tubular member 64, the chamber communicating with space 97 between the bellows members via a passage 98 of restricted cross-section formed through ring member 90. In use, the bellows space contains a liquid, and chamber 96 is charged with pressurized gas. For charging and venting chamber 96, a capped charging valve 100 and a vent plug 102, respectively, are provided in tubular member 64, the valve and plug communicating with chamber 96 through passages 104 and 106, respectively.

Valve element 88 has sealing sections **88*a*, 88*b*, which cooperate with the exterior of cylinder 66, and passages 108 connect the interior and exterior of the valve element. Clearance is provided between the valve element and outer cylinder 68 and between the bellows members and the inner and outer cylinders. Thus, the entire exterior of the bellows assembly will, in use, be subject to pump discharge pressure. When the bellows assembly is extended, as shown in FIG. 2, valve element 88 obturates ports 78**.

When the pump installation has been installed in a well, for example in the manner described in U.S. Pat. No. 4,171,934 aforesaid, and prior to operation of the pump, it is arranged that the pressure on the liquid in the enclosed bellows space, due to the gas pressure in chamber 96, is higher than the pressure on the exterior of the bellows assembly, so that the assembly remains extended with valve element 88 covering ports 78.

On start-up of the pump, liquid pressure builds up externally of the bellows assembly, and when the pressure on the exterior of the bellows assembly exceeds the interior pressure due to the gas in chamber 96, the bellows members begin to retract, thereby lifting valve element 88, opening ports 78, and allowing well liquid to be pumped through the discharge head. The rate of movement of the valve element is controlled by the rate at which liquid from within the bellows space can flow through the restricted passages 98 which thus provide a means for damping the movement of the valve element. Advantageously, the valve element should move relatively slowly since this prevents shock to the pumping system and eliminates possible instability.

As the ports 78 open, the pressure on the exterior of the bellows assembly will drop. When the interior and exterior bellows pressures are equalized, retracting movement of the bellows members ceases and the valve element remains in a position in which ports 78 are partially open. The valve element remains in this position until the well tubing is nearly filled. Then, pump discharge pressure rises, thereby increasing the pressure on the bellows exterior, so that valve element 88 retracts further, to fully open ports 78 (FIG. 3). This position is maintained during continued pumping of liquid from the well. Should the pressure externally of the bellows assembly at any time fall below the internal pressure, the valve element will move in a port-closing direction, and conversely, when the external pressure rises above the internal pressure, the valve element will move in a port-opening direction.

It will be understood that the interior of the bellows assembly is subject to the pressure of gas in chamber 96, which provides a reference pressure independent of environmental downhole pressure. The exterior of the bellows assembly is subject to liquid pressure at the pump discharge. Accordingly, the position of the valve element relative to ports 78 is dependent on the relationship between liquid pressure at the pump discharge and the reference pressure and the valve element will only open the ports when liquid pressure at the pump discharge exceeds the reference pressure and the bellows assembly retracts. Clearly, in use, the reference pressure will be set at a value that provides a suitable back-pressure for satisfactory operation of the pump.

At times when pump discharge pressure tends to exert an upward axial thrust on the shaft 74, for example during start-up of the pump, when ports 78 are closed, the thrust is accommodated by the compressability of washer 86.

Figure 4:
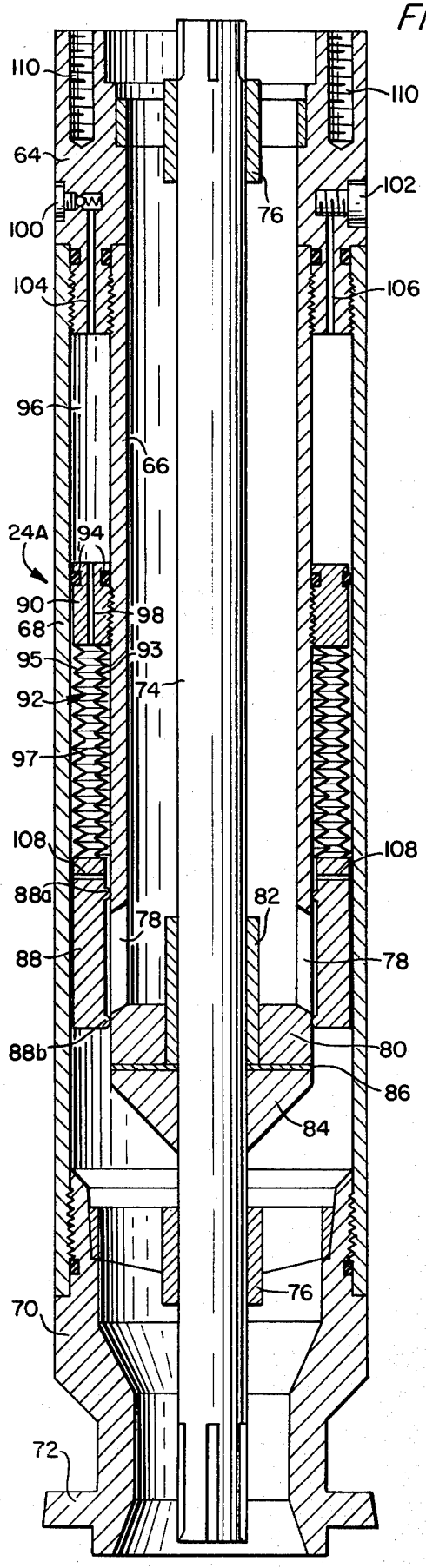
FIG. 4 is a sectional elevation of one form of discharge head fitting for attachment to a conventional type of pump discharge head, to provide an assembly in accordance with the invention.

FIG. 4 shows a discharge head fitting 24A which may be attached, for example, to the base member of an existing discharge head (e.g., of the type shown in U.S. Pat. No. 4,171,934) to provide an assembly in accordance with the present invention. Like reference numerals are used in FIG. 4 to note parts equivalent to those in the previous embodiment, and it will be appreciated that the assemblies operate in the same manner. It will be noted that tubular member 64 in this case forms the head of the fitting and may be provided with tappings 110 by which the fitting may be attached to the base flange of the discharge head.

Figure 5:
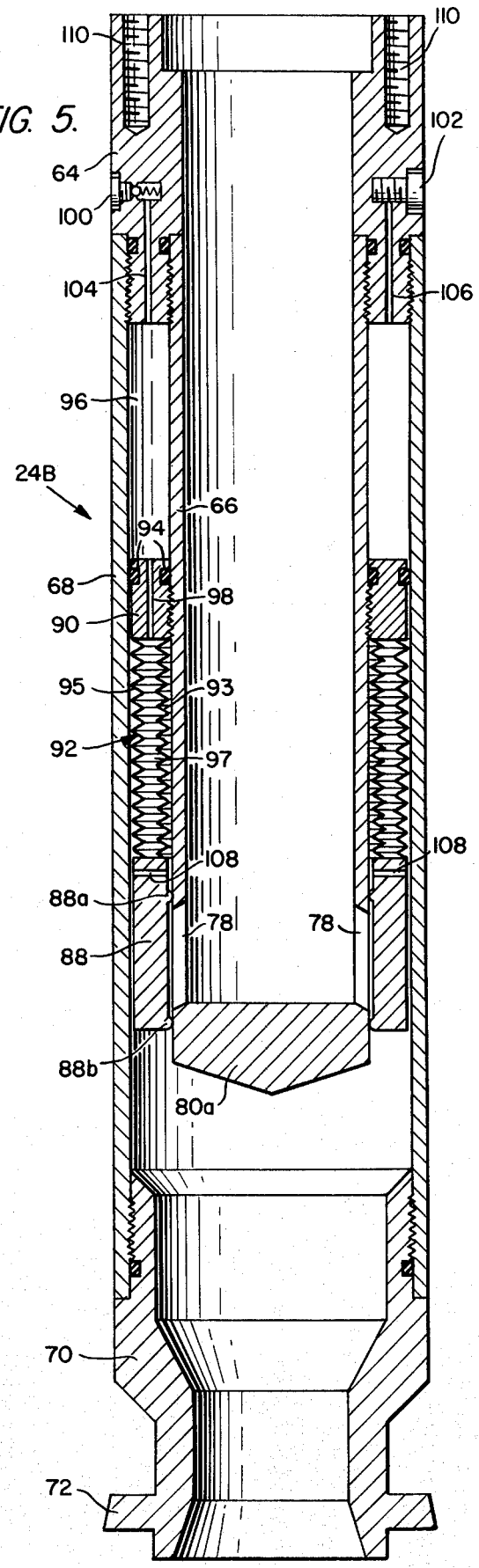
FIG. 5 is a sectional elevation of another form of discharge head fitting for attachment to a conventional type of discharge head.

FIG. 5 shows a similar discharge head fitting 24B which may be used with a discharge head where no drive shaft is required (for example, in installations where the drive motor is situated below the pump) to provide an assembly in accordance with the invention. Again, in this figure, like reference numerals are used to denote parts equivalent to those in the previous embodiments. In this case, a plain plate 80*a* seals the base of inner cylinder 66.

It will be appreciated from the foregoing that the invention provides an advantageous control arrangement for a downwell pump, which provides pressure compensation ensuring that the pump will operate at all times against a suitable back pressure. While only preferred embodiments of the invention have been described herein in detail, the invention is not limited thereby and modifications can be made within the scope of the attached claims. For example, the invention may be applied in pump discharge heads other than the specific form of discharge heads described. Additionally, while in the illustrated embodiments, the valve element 88 operates in conjunction with the inlet ports 78, it may alternatively be possible for the valve element to cooperate with the discharge ports 40. Further, the bellows assembly may be omitted and suitable sliding seals provided between valve element 88 and members 66 and 68. With this arrangement, the valve element acts as a piston subject on one end to the pressure of liquid at the pump discharge and on the other end to the reference pressure.

I claim:

1. A discharge assembly in a downwell submergible pump installation including port means through which pumped liquid is adapted to flow from a pump discharge through the assembly, movable valve means for opening and closing the port means, and control means that positions the valve means relative to the port means in accordance with the relationship between liquid pressure at the pump discharge, urging the valve means to open the port means, and a reference pressure, urging the valve means to close the port means, the reference pressure being independent of downwell environmental pressure, said control means positioning the valve means relative to the port means when the pump is not operating so as to substantially impede the pump discharge through the assembly when the pump is started and to provide suitable back pressure at the pump discharge for satisfactory start-up of the pump, and said control means positioning the valve means relative to the port means to open the port means fully when the pump has been operating for a sufficient period to overcome said reference pressure.

2. An assembly as defined in claim 1, wherein the relationship between liquid pressure at the pump discharge and the reference pressure is such that the port means is partially open for a period of time after the pump has started, and then, when the pump has pumped sufficient liquid, the port means is fully open.

3. An assembly as defined in claim 1, wherein the control means includes damping means for controlling the speed of movement of the valve means between port-opening and port-closing positions.

4. An assembly as defined in claim 1, wherein the control means includes a bellows assembly adapted to extend and retract to move the valve means between port-opening and port-closing positions, the bellows assembly having an interior space subject to the reference pressure with the exterior of the bellows assembly being subject to liquid pressure at the pump discharge.

5. An assembly as defined in claim 4, wherein the interior space of the bellows assembly is filled with liquid and communicates with a pressure chamber via passage means of restricted cross section, the pressure chamber containing a gas at the reference pressure.

6. An assembly as defined in claim 1 in the form of an elongate pump discharge head having a cylindrical member defining said port means, and wherein said valve means comprises a valve element of tubular form cooperating with said cylindrical member.

7. An assembly as defined in claim 6, wherein said cylindrical member is located internally of the discharge assembly and the valve element cooperates externally with the cylindrical member.

8. An assembly as defined in claim 6, wherein said port means comprises inlet port means for admitting liquid from the pump discharge into the assembly and wherein the assembly further includes discharge port means for the discharge of liquid from the assembly.

9. A discharge assembly for a submergible pump installation including port means through which pumped liquid is adapted to flow when passing from a pump discharge through the assembly, movable valve means for opening and closing the port means, and control means for positioning the valve means relative to the port means dependent on the relationship between liquid pressure at the pump discharge and a reference pressure that is independent of environmental pressure, whereby the valve means opens the port means only when the pressure at the pump discharge exceeds the reference pressure, said discharge assembly being in the form of an elongate pump discharge head having a cylindrical member defining said port means, said valve means comprising a valve element of tubular form cooperating with said cylindrical member, and wherein the control means includes tubular inner and outer bellows members connected with the valve element, the bellows members being adapted to extend and retract to move the valve element between port-opening and port-closing positions, the bellows members defining an interior space therebetween subject to the reference pressure, and the exterior of the bellows members being subject to liquid pressure at the pump discharge.

10. An assembly as defined in claim 9, wherein the interior space is filled with liquid and communicates with a pressure chamber via passage means of restricted cross section, the pressure chamber containing a gas at the reference pressure.

* * * * *